US012326311B2

(12) United States Patent
Finamore

(10) Patent No.: US 12,326,311 B2
(45) Date of Patent: Jun. 10, 2025

(54) MODULAR BOLT ACTION

(71) Applicant: Brian Finamore, St. James, NY (US)

(72) Inventor: Brian Finamore, St. James, NY (US)

( * ) Notice: Subject to any disclaimer, the term of this patent is extended or adjusted under 35 U.S.C. 154(b) by 0 days.

(21) Appl. No.: 18/227,891

(22) Filed: Jul. 28, 2023

(65) Prior Publication Data

US 2024/0035764 A1 Feb. 1, 2024

Related U.S. Application Data

(60) Provisional application No. 63/393,033, filed on Jul. 28, 2022.

(51) Int. Cl.

| | |
|---|---|
| ***F41A 3/66*** | (2006.01) |
| ***F41A 3/18*** | (2006.01) |
| ***F41A 35/06*** | (2006.01) |

(52) U.S. Cl.

CPC ..... *F41A 3/66* (2013.01); *F41A 3/18* (2013.01); *F41A 35/06* (2013.01)

(58) Field of Classification Search

CPC .... F41A 35/06; F41A 3/18; F41A 3/22; F41A 3/20

See application file for complete search history.

(56) References Cited

U.S. PATENT DOCUMENTS 6,508,025 B1 * 1/2003 Du Plessis ..... F41A 15/12 42/16
9,429,382 B2 * 8/2016 Ives ..... F41A 3/22

FOREIGN PATENT DOCUMENTS

FR 3020870 A1 * 11/2015 ..... F41A 19/34

OTHER PUBLICATIONS

FR 3020870 A1 (Year: 2015).*

* cited by examiner

*Primary Examiner* — Reginald S Tillman, Jr.
(74) *Attorney, Agent, or Firm* — Kutak Rock LLP; Brian L. Main

(57) ABSTRACT

A modular bolt action for a bolt action firearm is provided. The bolt action includes a receiver and a bolt assembly, the receiver being reconfigurable in a variety of different ways to accommodate a variety of different bolt assemblies. In this way, the modular bolt action can be reconfigured from a left-handed action to a right-handed action and/or from a two-lug action to a three-lug action. Fabrication of the modular bolt action includes adjusting the receiver to accommodate a desired bolt assembly and engaging such bolt assembly with the receiver.

15 Claims, 6 Drawing Sheets

MODULAR BOLT ACTION

CROSS-REFERENCE TO RELATED APPLICATIONS

This application claims priority pursuant to 35 U.S.C. 119(e) to U.S. Provisional Patent Application Ser. No. 63/393,033, filed Jul. 28, 2022, the entire disclosure of which is incorporated herein by reference.

FIELD OF THE INVENTION

The present invention relates generally to firearms. More specifically, the present invention is concerned with modular bolt actions for bolt action rifles.

BACKGROUND

Traditional bolt action rifles are limited to either left-handed or right-handed configurations. Because most shooters shoot right-handed, most bolt action rifles are right-handed. Although left-handed shooters can manipulate right-handed bolt action rifles (or vice-versa), it is not desirable. Accordingly, it would be beneficial to have a system for and a method of quickly and easily converting a bolt action rifle between left-handed and right-handed configurations.

Existing receivers are designed for a single use purpose, thereby increasing costs associated with storing various configurations of completed receivers. Accordingly, it would be beneficial to have a receiver assembly having a receiver body and various optional components associated therewith, thereby providing flexibility to configure (and/or reconfigure) the receiver assembly into a variety of desired configurations.

As accessories are becoming larger and more prevalent, the traditional space allotted for bolt manipulation may shrink in size. Accordingly, it would be beneficial to have a bolt action that can be reconfigured to accommodate future changes.

SUMMARY

The present invention comprises a modular bolt action that can be quickly and easily converted between left-handed and right-handed configurations. In some embodiments, the modular bolt action includes a receiver assembly having a receiver body and an extraction cam coupled thereto. In some embodiments, the extraction cam is either a left-handed extraction cam or a right-handed extraction cam such that converting the modular bolt action between left-handed and right-handed configurations includes replacing the existing extraction cam with a new extraction cam.

In some embodiments, the modular bolt action is configured to receive a plurality of bolt assembly configurations, thereby facilitating replacement of a right-handed bolt assembly with a left-handed bolt assembly. In some such embodiments, the receiver assembly includes receiver lugs that are configured to move in and out of engagement with locking lugs of left-handed and right-handed bolt assemblies, thereby facilitating movement of such bolt actions in and out of a locked configuration. When the bolt assembly is in an unlocked configuration, the bolt action is moveable between a closed configuration and an open configuration. When moving the left-handed and right-handed bolt actions towards their respective open configurations, the bolt actions are configured to eject cartridges (or unfired rounds) away from the shooter.

The present invention includes a receiver assembly having a receiver body and various optional components associated therewith, thereby providing flexibility to configure and/or reconfigure the receiver assembly.

The present invention includes a bolt action that can be reconfigured to accommodate a variety of future changes, thereby facilitating use of a variety of accessories now known or later develop. In some embodiments, the action of the present invention can be modified from a two lug configuration to a three lug configuration, such as by replacing a bolt assembly and/or replacing receiver lugs.

The foregoing and other objects are intended to be illustrative of the invention and are not meant in a limiting sense. Many possible embodiments of the invention may be made and will be readily evident upon a study of the following specification and accompanying drawings comprising a part thereof various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1A:
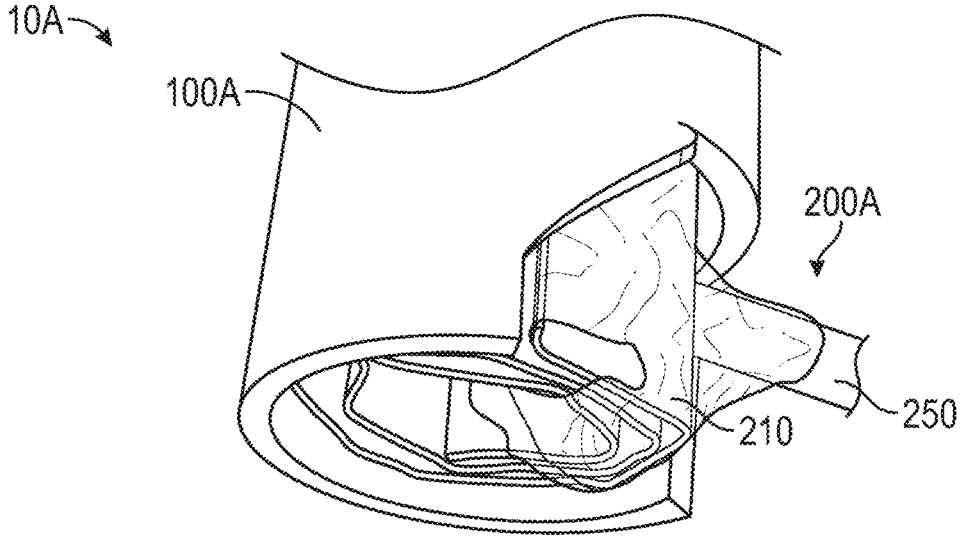
FIG. 1A is a partial perspective view of a mock-up of a first embodiment of a bolt action of the present invention, a bolt assembly of the bolt action being shown in a locked configuration.
Figure 1B:
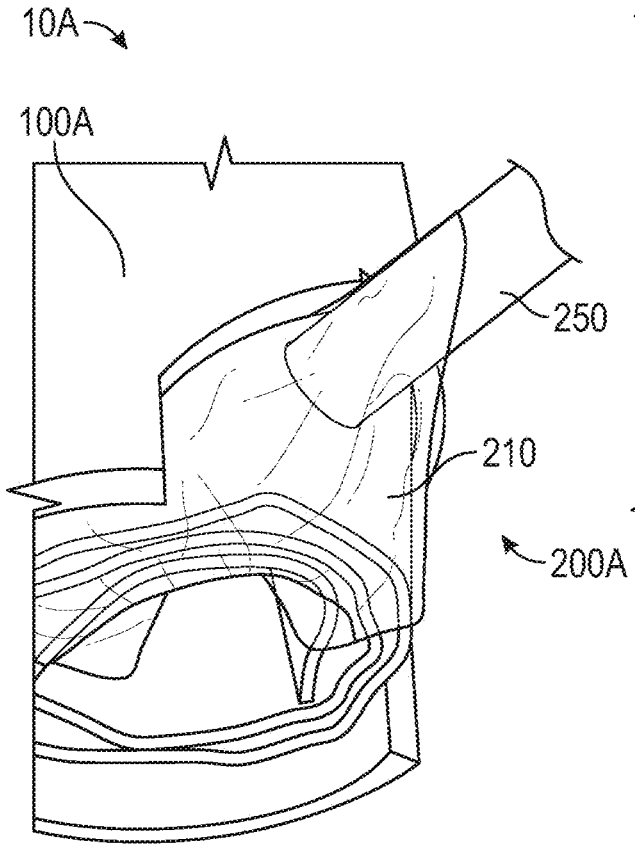
FIG. 1B is a partial perspective view of the bolt action of FIG. 1A, the bolt action shown in a closed configuration.
Figure 1C:
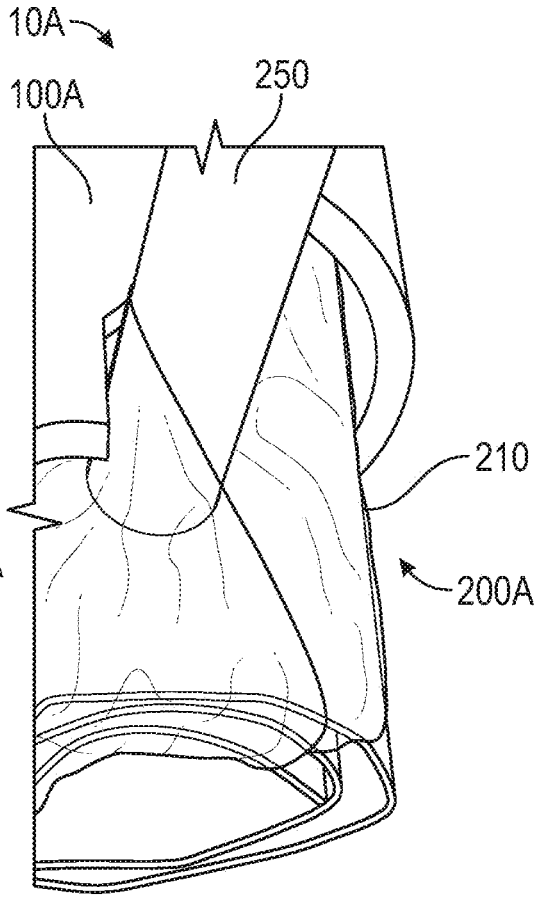
FIG. 1C is a partial perspective view of the bolt action of FIG. 1A, the bolt action shown in an open configuration.

Referring to FIGS. 1A-1C, a first bolt action 10A of the present invention includes a first receiver assembly 100A that receives a first bolt assembly 200A. The first bolt assembly 200A includes a bolt body 210 and a bolt handle 250 extending radially therefrom. The first bolt assembly 200A is moveable between locked (FIG. 1A) and unlocked (FIG. 1B) configurations by rotating the first bolt assembly 200A relative to the first receiver assembly 100A. While in the locked configuration, the first bolt assembly 200A is prevented from translating in the longitudinal direction, thereby facilitating firing a round associated therewith. When in the unlocked configuration, the first bolt assembly 200A is free to translate in the longitudinal direction, thereby facilitating movement of the first bolt action 10A between closed (FIG. 1B) and open (FIG. 1C) configurations. When in the open configuration, the first bolt action 10A facilitates loading rounds into a firearm for firing and expelling cartridge shells of such rounds after firing (or unloading rounds if not firing).

Figure 2A:
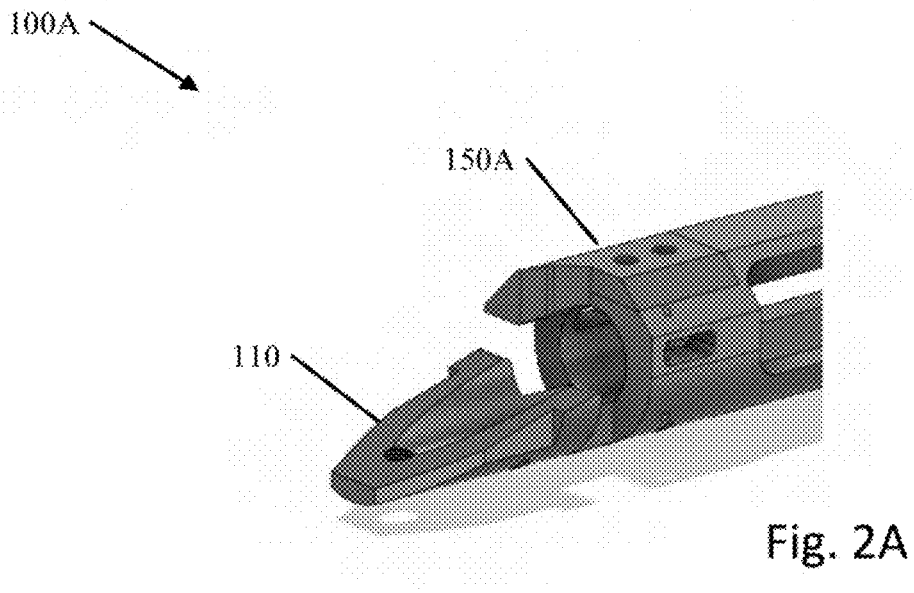
FIG. 2A is a partial perspective view of a receiver assembly of the bolt action of FIG. 1A.
Figure 2B:
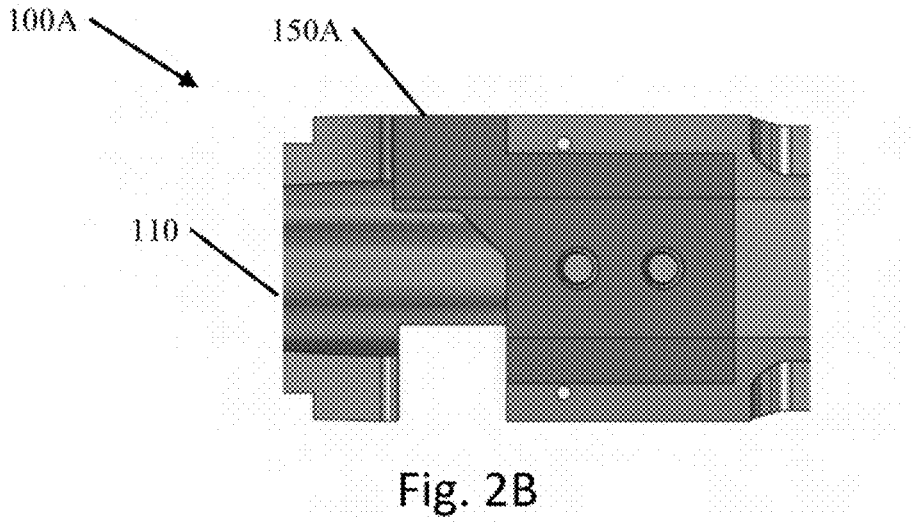
FIG. 2B is a partial top plan view of the receiver assembly of FIG. 2A.
Figure 2C:
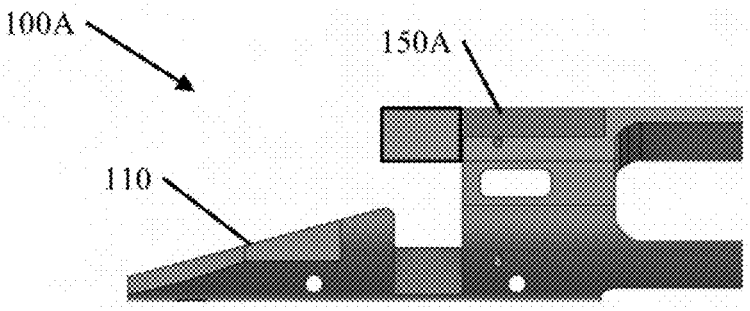
FIG. 2C is a partial side elevation view of the receiver assembly of FIG. 2A.

Referring to FIGS. 2A-2C, the first receiver assembly 100A includes a receiver body 110 and a first extraction cam 150A coupled thereto. The first extraction cam 150A is configured to engage with the bolt handle 250 upon the first bolt assembly 200A reaching the unlocked configuration. As the first bolt action 10A moves between the closed and open configurations, the bolt handle 250 remains engaged with the first extraction cam 150A. In this way, a profile of the first extraction cam 150A defines the travel of the bolt handle 250, thereby defining travel of the first bolt assembly 200A during loading and reloading of the firearm. In some embodiments, the first extraction cam 150A is a left-handed or right-handed extraction cam that is configured to engage with a left-handed or right-handed bolt assembly, respectively. In some embodiments, moving the modular bolt action from the left-handed configuration to the right-handed configuration comprises replacing a left-handed extraction cam with a right-handed extraction cam and replacing a left-handed bolt assembly with a right-handed bolt assembly. In some such embodiments, moving the modular bolt action from the left-handed configuration to the right-handed configuration consists primarily or exclusively of replacing a left-handed extraction cam with a right-handed extraction cam and replacing a left-handed bolt assembly with a right-handed bolt assembly. In some embodiments, replacing a left-handed bolt assembly with a right-handed bolt assembly comprises converting a left-handed bolt assembly with a right-handed bolt assembly.

Figure 3A:
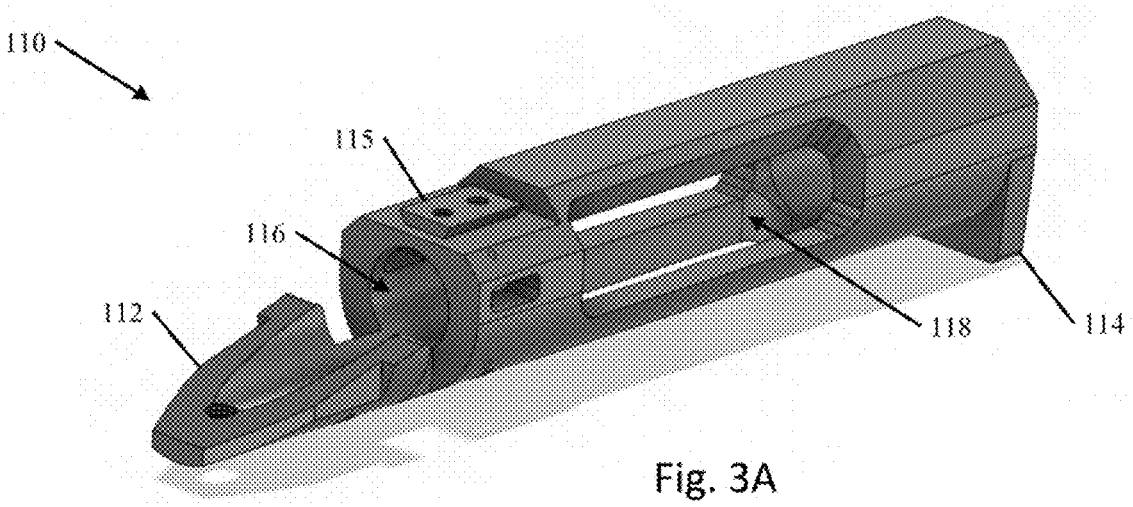
FIG. 3A is a perspective view of a receiver body of the present invention.
Figure 3B:
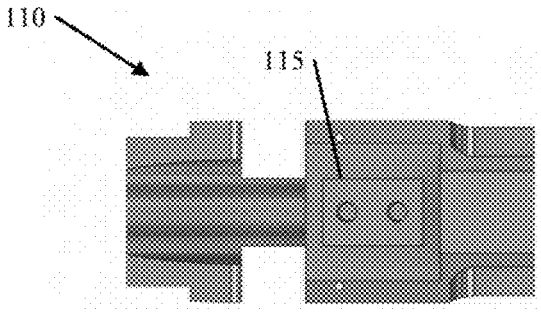
FIG. 3B is a partial top plan view of the receiver body of FIG. 3A.
Figure 3C:
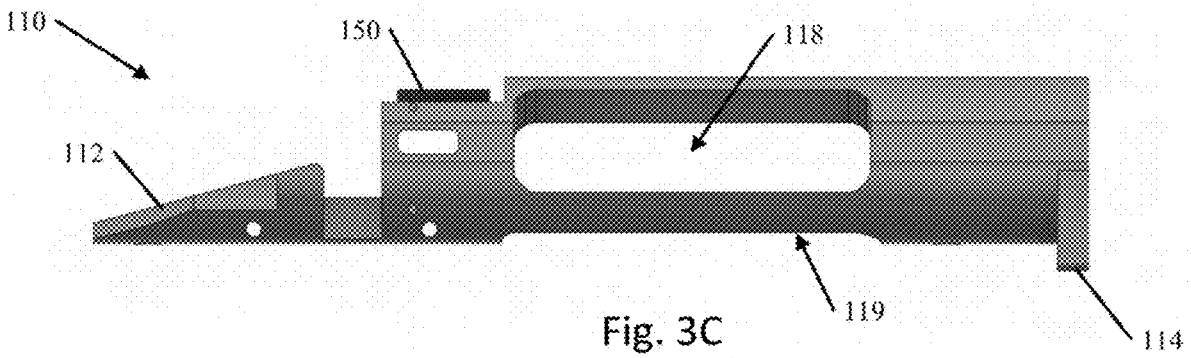
FIG. 3C is a side elevation view of the receiver body of FIG. 3A.

Referring to FIGS. 3A-3C, a receiver body 110 of the present invention includes opposed first and second ends having a rear tang 112 and an integral lug 114, respectively. The receiver body 110 defines an inner cavity 116 for receiving a bolt assembly, the inner cavity extending longitudinally from the rear tang 112 past the integral lug 114. The receiver body 110 further defines left and right side openings 118 in communication with the inner cavity 116, thereby facilitating loading rounds into the inner cavity when the bolt action is in an open configuration and ejecting cartridge shells (or rounds) from the inner cavity as the bolt action moves towards the open configuration. In some embodiments, the receiver body 110 further defines a bottom opening 119 in communication with the inner cavity 116, thereby facilitating loading rounds from a magazine associated therewith.

Still referring to FIGS. 3A-3C, the receiver body 110 of the present invention further includes a cam base 115 that is configured to interface with an extraction cam 150, thereby facilitating configuring the bolt action as a left-handed bolt action or a right-handed bolt action, as desired, or reconfiguring left-handed and right-handed bolt actions to right-handed and left-handed bolt actions, respectively.

Figure 4A:
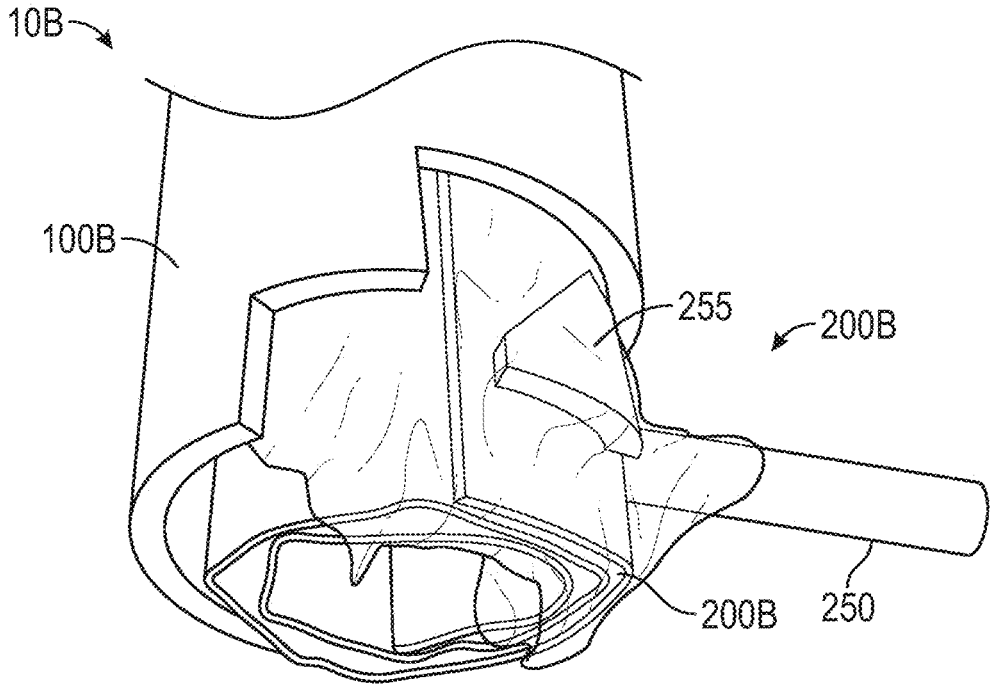
FIG. 4A is a partial perspective view of a mock-up of a second embodiment of a bolt action of the present invention, a bolt assembly of the bolt action being shown in a locked configuration.
Figure 4B:
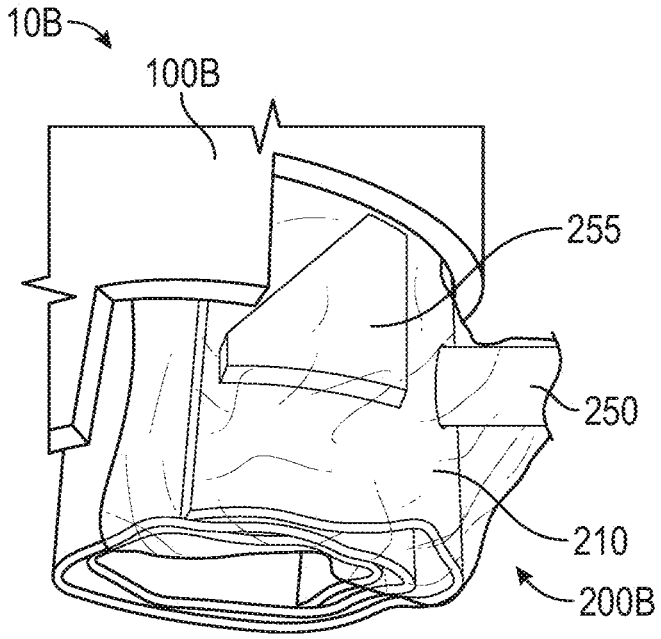
FIG. 4B is a partial perspective view of the bolt action of FIG. 4A, the bolt action shown in a closed configuration.
Figure 4C:
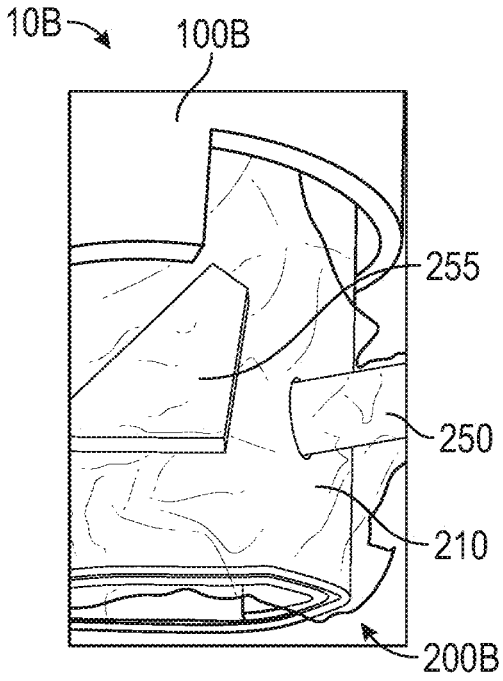
FIG. 4C is a partial perspective view of the bolt action of FIG. 4A, the bolt action shown in an open configuration.

Referring to FIGS. 4A-4C, a second bolt action 10B of the present invention includes a second receiver assembly 100B that receives a second bolt assembly 200B. The second bolt assembly 200B includes a bolt body 210, a bolt handle 250 extending radially therefrom, and a bolt nub 255 positioned adjacent to the bolt handle 250. The second bolt assembly 200B is moveable between locked (FIG. 4A) and unlocked (FIG. 4B) configurations by rotating the second bolt assembly 200B relative to the second receiver assembly 100B. While in the locked configuration, the second bolt assembly 200B is prevented from translating in the longitudinal direction, thereby facilitating firing a round associated therewith. When in the unlocked configuration, the second bolt assembly 200B is free to translate in the longitudinal direction, thereby facilitating movement of the second bolt action 10B between closed (FIG. 4B) and open (FIG. 4C) configurations. When in the open configuration, the second bolt action 10A facilitates loading rounds into a firearm for firing and expelling cartridge shells of such rounds after firing (or unloading rounds if not firing).

Figure 5A:
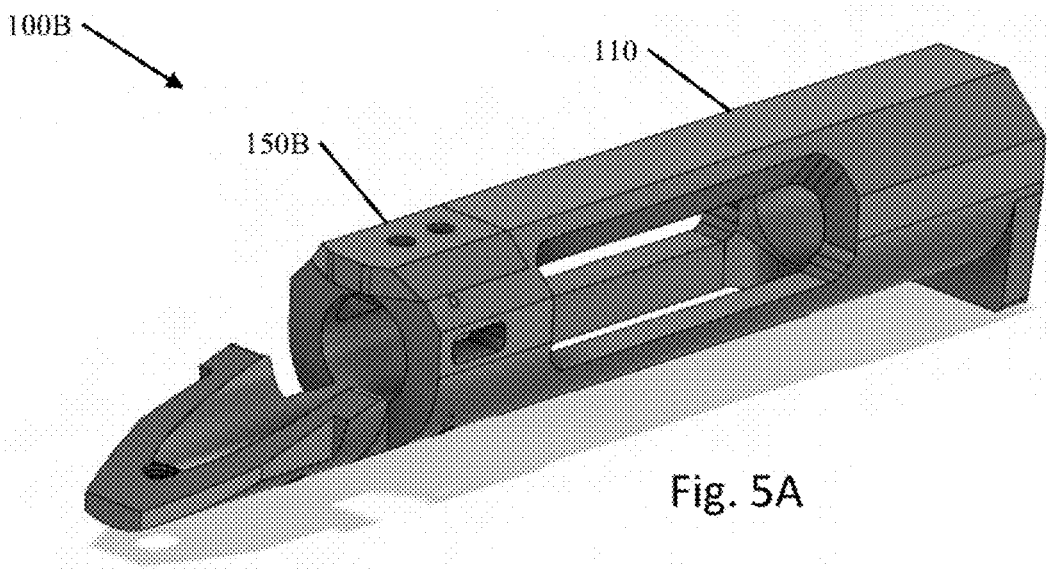
FIG. 5A is a partial perspective view of a receiver assembly of the bolt action of FIG. 4A.
Figure 5B:
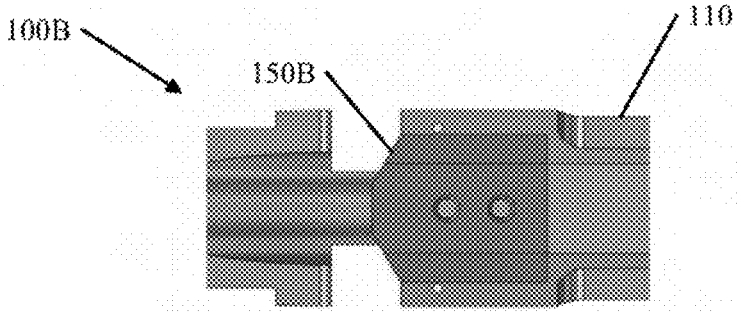
FIG. 5B is a partial top plan view of the receiver assembly of FIG. 5A.
Figure 5C:
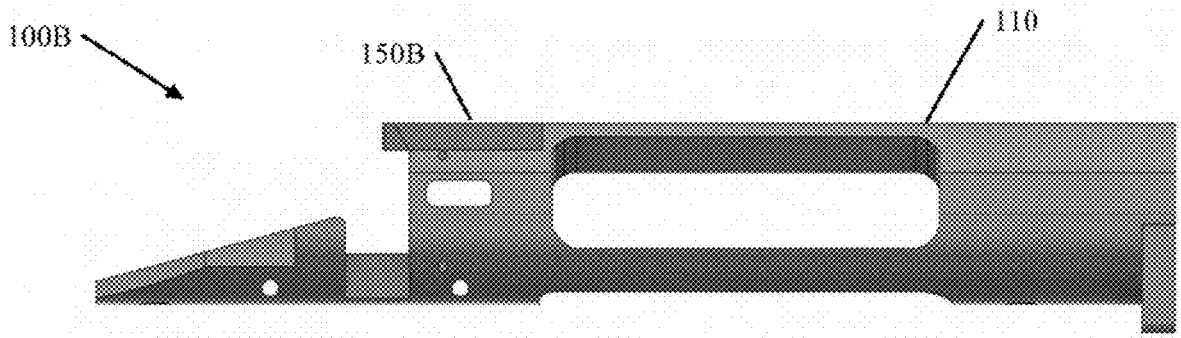
FIG. 5C is a partial side elevation view of the receiver assembly of FIG. 5A.

Referring to FIGS. 5A-5C, the second receiver assembly 100B includes a receiver body 110 and a second extraction cam 150B coupled thereto. The second extraction cam 150B is configured to engage with the bolt nub 255 upon the second bolt assembly 200B reaching the unlocked configuration. As the second bolt action 10B moves between the closed and open configurations, the bolt nub 255 remains engaged with the second extraction cam 150B. In this way, a profile of the bolt nub 255 defines the travel of the second bolt assembly 200B during loading and reloading of the firearm. In some embodiments, the second extraction cam 150B is an ambidextrous cam that is configured to engage with a left-handed bolt assembly or a right-handed assembly when the modular bolt action is in the left-handed or right-handed configuration, respectively. In some embodiments, moving the modular bolt action from the left-handed configuration to the right-handed configuration comprises replacing a left-handed bolt assembly with a right-handed bolt assembly. In some such embodiments, moving the modular bolt action from the left-handed configuration to the right-handed configuration consists primarily or exclusively of replacing a left-handed bolt assembly with a right-handed bolt assembly. In some embodiments, replacing a left-handed bolt assembly with a right-handed bolt assembly comprises converting a left-handed bolt assembly with a right-handed bolt assembly.

Figure 6A:
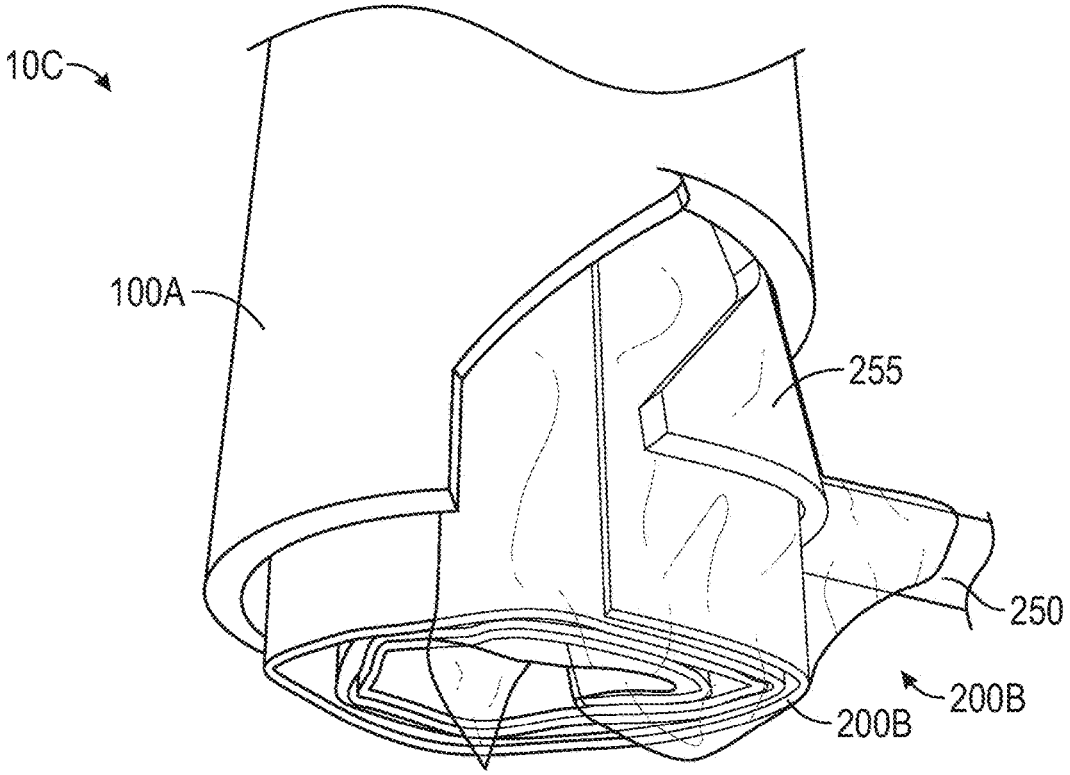
FIG. 6A is a partial perspective view of a mock-up of a third embodiment of a bolt action of the present invention, a bolt assembly of the bolt action being shown in a locked configuration.
Figure 6B:
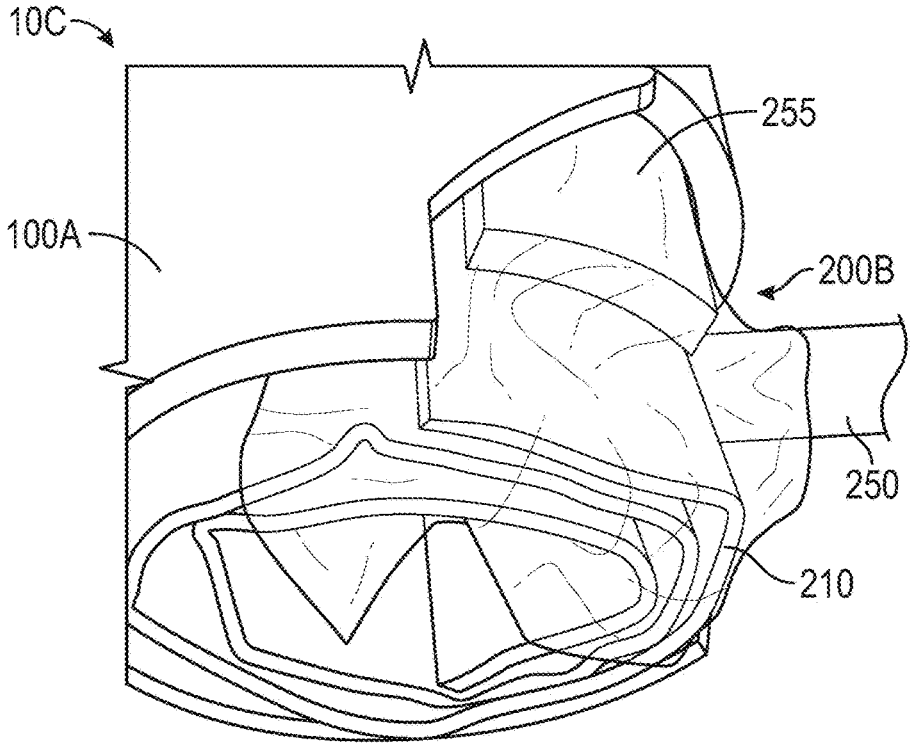
FIG. 6B is a partial perspective view of the bolt action of FIG. 6A, the bolt action shown in a closed configuration.

Referring to FIGS. 6A-6B, a third bolt action 10C of the present invention includes the first receiver assembly 100A, which receives the second bolt assembly 200B. The first extraction cam 150A is configured to engage with the bolt nub 255 upon the second bolt assembly 200B reaching an unlocked configuration. As the third bolt action 10B moves between closed and open configurations, the bolt nub 255 remains engaged with the first extraction cam 150A. In this way, profiles of the first extraction cam 150A and the bolt nub 255, together, define the travel of the second bolt assembly 200B during loading and reloading of the firearm. It will be appreciated that other embodiments of the present invention utilize the second bolt assembly 200B with other existing or modified receivers, such as those with integrated cams or other features for engaging with the nub 255 of the second bolt assembly 200B.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A modular bolt action comprising:

a receiver assembly comprising a receiver body and an extraction cam coupled thereto; and a bolt assembly comprising a bolt body and a bolt handle extending outwardly from a first portion of said bolt body, said receiver body defining an inner cavity for receiving a second portion of said bolt body, wherein the modular bolt action is movable between a right-handed configuration and a left-handed configuration, wherein said bolt assembly rotates about a longitudinal axis of said receiver assembly as said bolt assembly moves between a locked configuration and an unlocked configuration, wherein said bolt assembly slides along the longitudinal axis as the bolt assembly moves between a closed configuration and an open configuration, wherein the modular bolt action is one of a first type or a second type, wherein for the first type of modular bolt action;

said extraction cam is a left-handed extraction cam or a right-handed extraction cam, and moving the modular bolt action from the left-handed configuration to the right-handed configuration comprises replacing a left-handed extraction cam with a right-handed extraction cam, and wherein for the second type of modular bolt action;

said extraction cam is an ambidextrous extraction cam;

the bolt assembly is a left-handed bolt assembly or a right-handed bolt assembly; and moving the modular bolt action from the left-handed configuration to the right-handed configuration comprises replacing the left-handed bolt assembly with the right-handed bolt assembly.

2. The modular bolt action of claim 1, wherein moving said bolt assembly towards the locked and unlocked configurations comprises rotating said bolt assembly in first and second directions, respectively, and wherein the first direction is opposed to the second direction.

3. The modular bolt action of claim 2, wherein said extraction cam is configured to engage with said bolt handle when said bolt assembly is in the unlocked configuration, and wherein a profile of said extraction cam defines travel of the bolt handle as the bolt assembly moves between the open and closed configurations.

4. The modular bolt action of claim 2, wherein said bolt body further comprises a bolt nub configured to engage with said extraction cam upon said bolt assembly reaching said unlocked configuration, wherein said bolt nub defines travel of said bolt assembly as the bolt assembly moves between the open and closed configurations.

5. The modular bolt action of claim 1, wherein said bolt assembly is prevented from moving between the open and closed configurations while said bolt assembly is in the locked configuration.

6. The modular bolt action of claim 1, wherein said receiver body further defines left and right side openings in communication with the inner cavity.

7. The modular bolt action of claim 6, wherein the left and right side openings are configured to facilitate loading a round into the inner cavity of said receiver body when the modular bolt action is in the left-handed or right-handed configuration, respectively.

8. The modular bolt action of claim 1, wherein said extraction cam is configured to engage with said bolt assembly upon said bolt assembly reaching the unlocked configuration, and wherein said extraction cam remains engaged with said bolt assembly as said bolt assembly slides away from the closed configurations.

9. The modular bolt action of claim 1, wherein replacing the left-handed bolt assembly with the right-handed bolt assembly comprises converting the left-handed bolt assembly to the right-handed bolt assembly, and wherein converting the bolt assembly comprises removing a first nub from a bolt of the bolt assembly and installing a second nub to the bolt of the bolt assembly.

10. A method of converting a firearm from a left-handed configuration to a right-handed configuration, the firearm comprising a modular bolt action having a receiver assembly and a bolt assembly, the receiver assembly having a receiver body and a left-handed extraction cam, the method comprising:

removing the left-handed extraction cam from the receiver body and installing a right-handed extraction cam to the receiver body.

11. A method of converting a firearm from a left-handed configuration to a right-handed configuration, the firearm comprising a modular bolt action having a receiver assembly and a bolt assembly, the receiver assembly having a receiver body and an ambidextrous extraction cam, the method comprising:

disengaging and removing the bolt assembly from the modular bolt action, the bolt assembly being a first bolt assembly; and engaging with the modular bolt action one of the first bolt assembly and a second bolt assembly; and converting the first bolt assembly to the second bolt assembly by removing a first nub from a bolt of the bolt assembly and installing a second nub to the bolt of the bolt assembly, wherein the first bolt assembly is a left-handed bolt assembly, and wherein the second bolt assembly is a right-handed bolt assembly.

12. A firearm comprising:

a modular bolt action that is movable between a right-handed configuration and a left-handed configuration, the modular bolt action comprising:

a receiver assembly comprising a receiver body and an extraction cam coupled thereto; and a bolt assembly comprising a bolt body and a bolt handle extending outwardly from a first portion of said bolt body, said receiver body having opposed first and second ends and defining an inner cavity for receiving a second portion of said bolt body, wherein said bolt assembly rotates about an axis relative to said receiver assembly between a locked configuration and an unlocked configuration, the degree of said rotation limited by said extraction cam engaging with said bolt assembly at an engagement point, wherein said bolt assembly slides along said axis relative to said receiver assembly between a closed configuration and an open configuration, wherein said extraction cam is capable of removal from said receiver body, thereby facilitating a greater degree of rotation by said bolt assembly relative to said receiver assembly.

13. The firearm of claim 12, wherein said modular bolt action moving between said left-handed and right-handed configurations is facilitated by removing said extraction cam and rotating said bolt assembly past said engagement point.

14. The firearm of claim 13, wherein said extraction cam is a left-handed extraction cam or a right-handed extraction cam, and wherein moving the modular bolt action from the left-handed configuration to the right-handed configuration comprises replacing a left-handed extraction cam with a right-handed extraction cam.

15. The firearm of claim 12, wherein said extraction cam is a left-handed extraction cam or a right-handed extraction cam, and wherein moving the modular bolt action from the left-handed configuration to the right-handed configuration comprises replacing a left-handed extraction cam with a right-handed extraction cam.

* * * * *